United States Patent [19]

Benevento

[11] Patent Number: 4,498,247

[45] Date of Patent: Feb. 12, 1985

[54] VENT ATTACHMENT FOR A HOT AIR CLOTHES DRYER

[75] Inventor: Peter J. Benevento, West Hempstead, N.Y.

[73] Assignee: Lambro Industries, Inc., Amityville, N.Y.

[21] Appl. No.: 632,550

[22] Filed: Jul. 19, 1984

Related U.S. Application Data

[63] Continuation of Ser. No. 402,206, Jul. 26, 1982, abandoned.

[51] Int. Cl.[3] ..... F26B 11/04

[52] U.S. Cl. ..... 34/82; 34/86; 34/235

[58] Field of Search ..... 34/82, 86, 235; 55/463; 98/40 R

[56] References Cited

U.S. PATENT DOCUMENTS 2,567,915 9/1951 Smith ..... 98/40 R 4,183,150 1/1980 Nash ..... 34/235

*Primary Examiner*—Larry I. Schwartz

*Assistant Examiner*—David W. Westphal

*Attorney, Agent, or Firm*—Bauer & Amer

[57] ABSTRACT

As a construction improvement to the commonly used device that typically is attached to the hose of a "hot air" clothes dryer to assist in indoor venting of the hot air, the within hose-attached device has a conical shape projecting into the path of the incoming hot air which, after being impinged upon, deflects the hot air along angular paths which significantly increases the volume of the hot air which is effectively discharged through the exit openings of the device, and to this extent the within device thus correspondingly diminishes the volume of hot air which otherwise back flows through the hose and adversely effects the operation of the clothes dryer.

1 Claim, 4 Drawing Figures

VENT ATTACHMENT FOR A HOT AIR CLOTHES DRYER

This is a continuation of application Ser No. 402,206 filed July 26, 1982, now abandoned.

The present invention relates generally to hot air clothes dryer operation, and more particularly to an improved venting attachment to the hose of such clothes dryer which significantly improves the venting functioning thereof.

As understood, when a hot air-operated clothes dryer cannot be vented to the outdoors, the hose thereof is typically attached to a plastic venting device for properly supporting and otherwise stationarily maintining the hose in position while the hot air exits therefrom. Despite the apparent simple operating parameters, as above noted, the known hose-attached venting devices are nevertheless not entirely satisfactory. One typical shortcoming is that there is inadvertent partial blockage or inhibiting of the exiting flow of the hot air from the venting device, which manifests itself as a back pressure and adversely affects the operation of the clothes dryer.

Broadly, it is an object of the present invention to provide an improved venting attachment for a hot air-operated clothes dryer overcoming the foregoing and other shortcomings of the prior art. Specifically, it is an object to provide a clothes dryer hose attachment in which almost the same simple construction of the prior art is embodied therein, but an easily included structured modification thereto significantly obviates any back pressure or other undesirable interference with the hot air venting service thereof.

As already noted, the within venting device is of the type having an operative position in attached relation to the end of a hose of a hot air-operated clothes dryer to facilitate the exiting flow of hot air from said clothes dryer through said hose, and said venting device demonstrating objects and advantages of the present invention comprises a body bounding an inlet opening at said attachment of said vent device to said hose. Said body also includes wall means extending rearwardly from the inlet opening so as to define a chamber for receiving therein the hot air which is exiting through the hose and thus through the inlet opening. Completing the body of the device are exit openings for said hot air which, by necessity, are oriented substantially in the flow direction of the entering hot air. It is thus proposed, in accordance with the present invention, that there be an inwardly projecting conical shape in a wall of the body or chamber which is in facing relation to said inlet opening, and in this location said conical shape is adapted to be impinged upon by the hot air during the interval of its flow movement between said inlet and outlet openings. As a consequence of said impingement against said conical shape, there is angularly flowing hot air within the device which contributes to a marked increase in the volume of hot air which is vented through the exit openings of said venting device.

The above brief description, as well as further objects, features and advantages of the present invention, will be more fully appreciated by reference to the following detailed description of a presently preferred, but nonetheless illustrative embodiment in accordance with the present invention, when taken in conjunction with the accompanying drawings, wherein.

Figure 2:
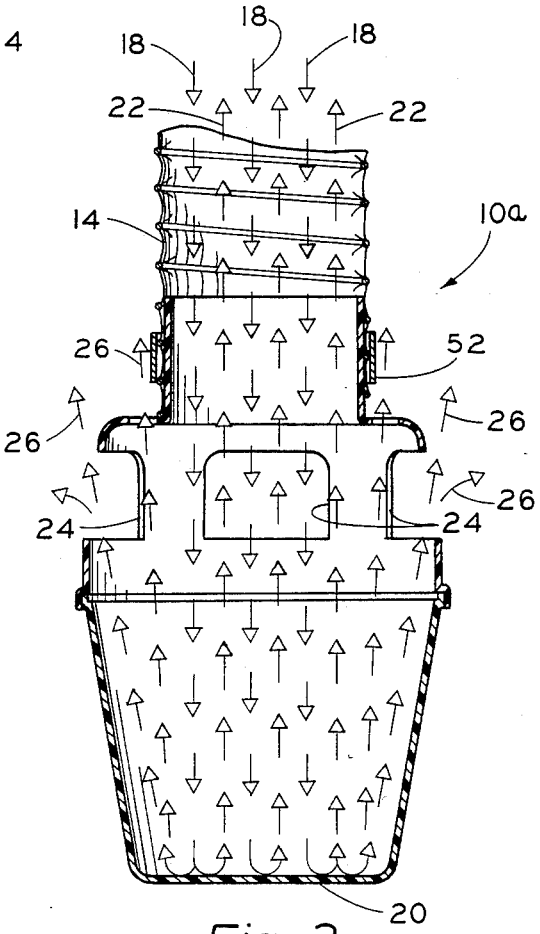
Fig. 2 PRIOR ART
FIG. 2 is a cross-sectional view on an enlarged scale, of a prior art construction in which there is illustrated by flow arrows, the inability of such device to properly cause exiting flow of the hot air.
Figure 3:
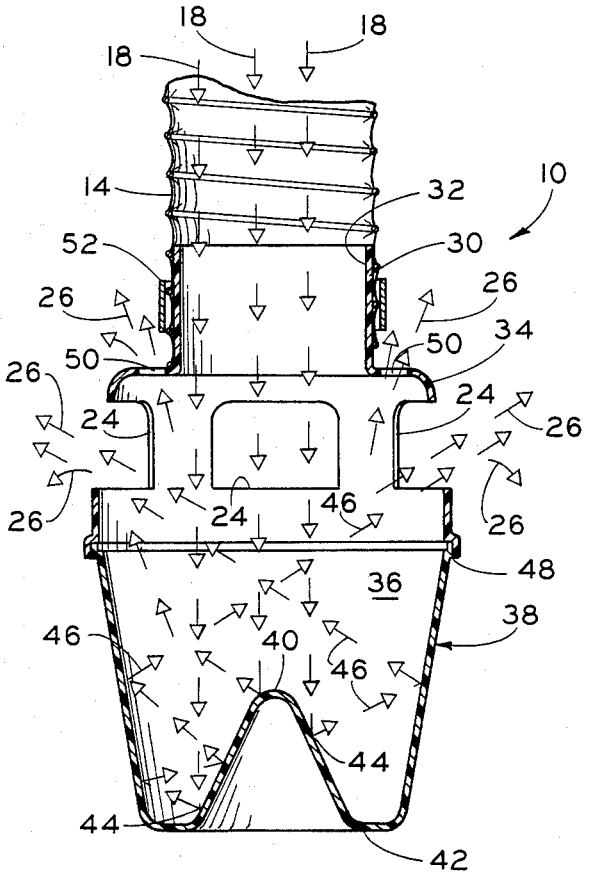
Figure 4:
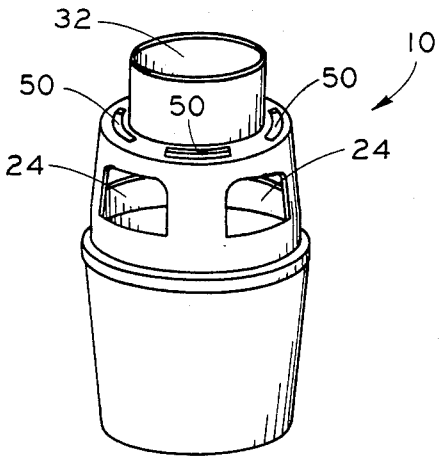

FIG. 3 is a cross-sectional view similar to FIG. 2, but illustrating the improved inventive construction of the within vent attachment, and wherein use is also made of flow arrows to illustrate the significantly improved flow path of the hot air which correspondingly significantly contributes to the functioning of the vent device in causing exiting flow of the hot air; and FIG. 4 is a perspective view of the inventive vent attachment illustrating further structural details thereof.

Figure 1:
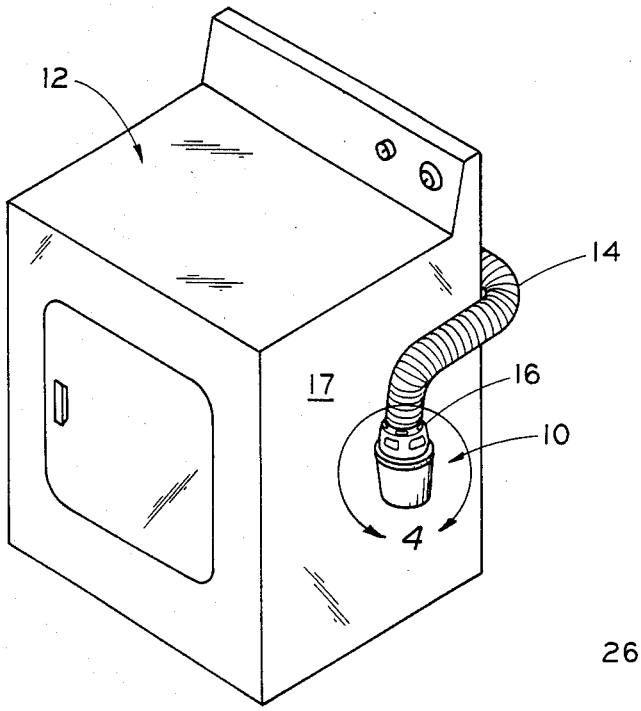
FIG. 1 is a perspective view illustrating the operative position of a clothes dryer vent attachment of the category herein involved.

The structural details of the within inventive vent device is shown more particularly in FIGS. 3 and 4, and reference thereto will be made thereto as the description proceeds. However, it is initially helpful to note the operative position, as shown in FIG. 1, of the vent device, which is generally designated 10 in said figure. As is well understood, and as is shown in FIG. 1, the device 10 is used in conjunction with the operation of a hot air-operated clothes dryer 12 which, for one reason or another, cannot be vented to the outdoors. Typically therefore, the dryer includes a flexible hose 14 for the exiting hot air which has in attached relation, as at 16, the vent device 10 which is appropriately supported, by adhesive securement, by a clamp, or the like, to a side 17 of the clothes dryer, all as is clearly illustrated in FIG. 1.

In the operating environment of FIG. 1 there are many already known attachments for the hose 14 to facilitate the venting of the hot air, one such prior art construction being illustrated in FIG. 2, to which reference should now be made. For present purposes, it suffices to note that said prior art device **10*a* is attached at one end to the hose 14 and has a body which extends rearwardly therefrom to receive the inflowing hot air, the flow path of which is indicated by the flow arrows individually and collectively designated 18. What typically occurs during the use of the prior art device 10*a*, is that the inflowing air 18 impinges upon a flat bottom wall 20, which changes its direction 180 degrees, as illustrated by the flow directional arrows individually and collectively designated 22. As shown in the upper portion of FIG. 2, this thus results in what can be characterized as a back flow 22 which is in opposition to the incoming flow 18 and which, as can readily be surmised, interferes with the discharge of the hot air from the clothes dryer 12. Stated another way, although the prior art device 10*a* has exit openings in its body, as examplified by the openings 24, because of the orientation of said openings, which is in a plane that is in the same direction as the flow path 18 and therefore also of the flow path 22, there is very little of the exiting hot air flowing through said openings, as exemplified by the few air flow arrows designated 26**.

Reference should now be made to FIGS. 3 and 4 which illustrate the construction embodied by the within inventive device which significantly improves its functioning insofar as eliminating the shortcoming just noted in connection with FIG. 2. More particularly, and as is perhaps best shown in FIG. 3, the inventive venting device 10 is also appropriately connected to the hose 14 so that there is inflowing hot air from the hose 14 into a cylindrical upper section 30 which bounds an inlet opening 32 into the body of the device 10. More particularly, said body, which consists of the wall means designated 34, extends rearwardly from the inlet opening 32 and bounds a chamber 36 for receiving the inflowing hot air 18. The significant structural feature added to the device 10 is embodied in a lower cylindrical section 38 and consists of an inwardly projecting conical shape, designated 40, which is formed in a central location in the bottom wall 42 of said section 38. As a result, by tracing the inflowing hot air 18, it will be noted that there is impingement of the inflowing hot air 18 upon the conical shape 40, as at the exemplary locations individually and collectively designated 44, and this results in a deflecting of said inflowing air 18 into angular flow paths, as illustrated by the exemplary flow paths designated 46. Once deflected along the angular flow paths 46, the hot air is then readily able to exit through the exit openings 24 in a significantly increased volume, as exemplified by the exit air flow arrows individually and collectively designated 26 in FIG. 3.

Stated another way, and as perhaps can best be appreciated by comparing FIGS. 2 and 3, the returning air flow 22 as is characteristic of the operation of the prior art construction, has been almost totally eliminated by the conical shape 40 of the improved construction of the FIG. 3 venting device, and instead the volume represented by said returning volume 22 is now effectively diverted out of the exit openings 24.

Although not an essential part of the within invention, for completeness' sake it is noted that the rear cylindrical section 38 is detachably connected by a snap fit or the like, as at 48, to the upper portion of the device 10 which includes the circumferentially spaced exit openings 24, as well as smaller-sized exit openings 50. When the hose 14 is placed externally over the upper conical section 30, it will be understood that it is held in place by an appropriate hose clamp 52.

A latitude of modification, change and substitution is intended in the foregoing disclosure, and in some instances, some features of the invention will be employed without a corresponding use of other features. Accordingly, it is appropriate that the appended claims be considered broadly and in a manner consistent with the spirit and scope of the invention herein.

What is claimed is:

1. A hot air venting device of a type having an operative position in attached relation to an end of a hose of a hot air-operated clothes dryer to facilitate the venting to atmosphere of hot air exiting from said clothes dryer through said hose, said venting device comprising a body having a cylindrical portion bounding an inlet opening at said attachment of said venting device to said hose for allowing the entry thereinto of said exiting hot air, said body having a side wall extending rearwardly from said inlet opening a back wall so as to define a chamber for receiving said hot air, said side wall having exit openings therein adjacent the upper end of said chamber which are oriented substantially in the flow direction of said entering hot air, the back wall oriented in facing relation to said inlet opening and said back wall comprising an inwardly projecting conical shape formed by substantially straight walls in cross section located centrally in said back wall and spaced rearwardly from said exit openings, said hot air flow being characterized such that the hot air first exits the hot air-operated clothes dryer, then passes through the hose and into the inlet of the venting device, the hot air then bypasses the exit openings and impinges upon said conical shape at the back wall, whereby the impingement against said conical shape causes angular flow paths in said hot air, the hot air then flows through said angular flow paths wherein the hot air is discharged through said exit openings, the conical shape which causes the angular flow paths contributes to increasing the volume of hot air which is vented through said exit openings of said venting device.

* * * * *